US011388517B2

(12) United States Patent
Grawe et al.

(10) Patent No.: US 11,388,517 B2
(45) Date of Patent: Jul. 12, 2022

(54) PLANAR LOUDSPEAKER

(71) Applicant: GRAWE & SCHNEIDER GDBR, Kiefersfelden (DE)

(72) Inventors: Thomas Andrew Grawe, Kiefersfelden (DE); Gerd-Peter Schneider, Landshut (DE); Peter Trossowski, Berlin (DE)

(73) Assignee: GRAWE & SCHNEIDER GDBR, Kiefersfelden (DE)

( * ) Notice: Subject to any disclaimer, the term of this patent is extended or adjusted under 35 U.S.C. 154(b) by 0 days.

(21) Appl. No.: 17/282,116

(22) PCT Filed: Sep. 30, 2019

(86) PCT No.: PCT/EP2019/076395
§ 371 (c)(1),
(2) Date: Apr. 1, 2021

(87) PCT Pub. No.: WO2020/070046
PCT Pub. Date: Apr. 9, 2020

(65) Prior Publication Data

US 2021/0377664 A1 Dec. 2, 2021

(30) Foreign Application Priority Data

Oct. 1, 2018 (DE) ..... 10 2018 124 261.1

(51) Int. Cl.
*H04R 9/06* (2006.01)
*H04R 7/04* (2006.01)
(Continued)

(52) U.S. Cl.
CPC ..... *H04R 7/04* (2013.01); *H04R 7/24* (2013.01); *H04R 9/041* (2013.01); *H04R 9/043* (2013.01);
(Continued)

(58) Field of Classification Search
CPC ... H04R 7/04; H04R 7/24; H04R 7/26; H04R 9/041; H04R 9/043; H04R 9/025;
(Continued)

(56) References Cited

U.S. PATENT DOCUMENTS 5,243,662 A 9/1993 Sogn et al.
5,664,024 A * 9/1997 Furuta ..... H04R 7/127 381/396
(Continued)

FOREIGN PATENT DOCUMENTS

DE 2850956 5/1979
DE 60315144 12/2007
(Continued)

*Primary Examiner* — Huyen D Le
(74) *Attorney, Agent, or Firm* — Bradley D. Crose; Crose Law LLC

(57) ABSTRACT

Planar loudspeaker comprising a planar sound panel (10), a mounting (12), at least one drive unit (14) for driving the sound panel (10), said drive unit preferably being attached to the mounting (12), and at least one stabilizing device (22) for stabilizing a movement of the sound panel (10), wherein the stabilizing device (22) is arranged between the sound panel (10) and the mounting (12) and comprises at least a stroke section (28), which is configured so as to be movable, flexible and/or elastic, and at least one centering device (36) for centering the sound panel (10) and/or at least a part of the drive unit (14), wherein the centering device (36) is arranged in a different plane than the stabilizing device (22) and comprises at least a stroke section (28), which is configured so as to be movable, flexible and/or elastic.

16 Claims, 5 Drawing Sheets

Figure 1:
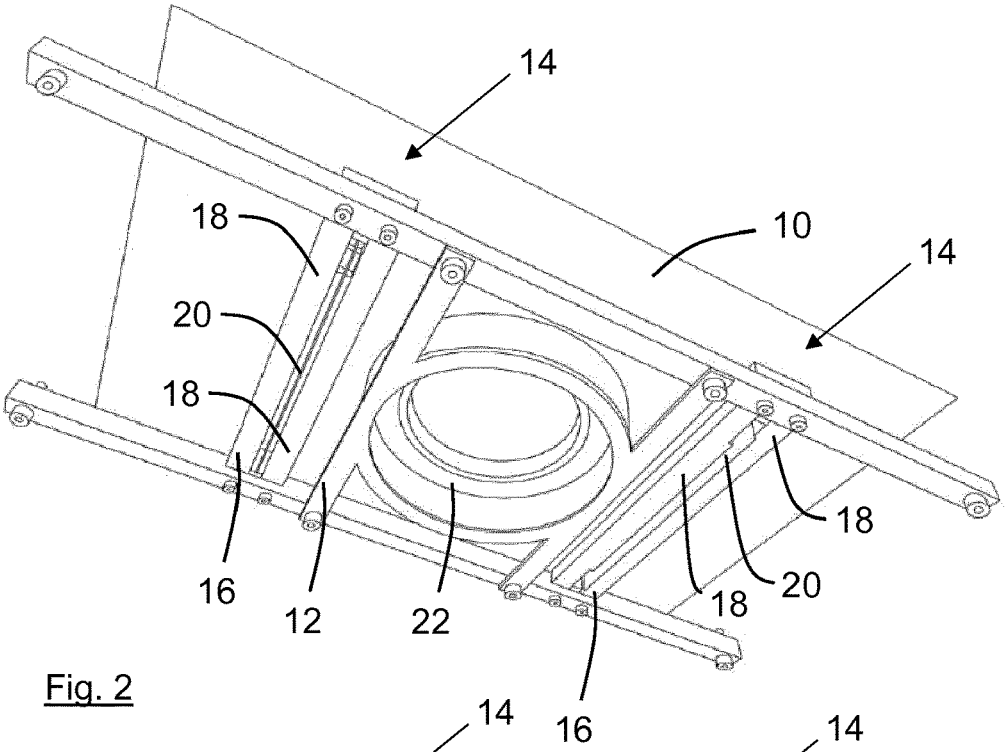

(51) Int. Cl.
*H04R 7/24* (2006.01)
*H04R 9/04* (2006.01)
*H04R 31/00* (2006.01)

(52) U.S. Cl.
CPC ..... *H04R 9/06* (2013.01); *H04R 31/006* (2013.01); *H04R 2499/15* (2013.01)

(58) Field of Classification Search
CPC ..... H04R 9/047; H04R 9/06; H04R 9/063; H04R 31/006; H04R 2499/15
See application file for complete search history.

(56) References Cited

U.S. PATENT DOCUMENTS

| | | | | |
|---|---|---|---|---|
| 2002/0118847 | A1 | 8/2002 | Kam | |
| 2002/0172392 | A1 | 11/2002 | Mikio | |
| 2003/0021435 | A1* | 1/2003 | Nakaso ..... | H04R 7/14 381/396 |
| 2005/0031155 | A1 | 2/2005 | Bachmann et al. | |
| 2005/0036647 | A1 | 2/2005 | Nguyen | |
| 2009/0257617 | A1 | 10/2009 | Ikeda | |

FOREIGN PATENT DOCUMENTS

| | | |
|---|---|---|
| DE | 102007003165 | 7/2008 |
| DE | 102011005292 | 9/2012 |
| DE | 102014201693 | 6/2015 |
| DE | 202015101126 | 6/2016 |
| DE | 102015103339 | 9/2016 |
| GB | 312756 | 4/1928 |
| JP | S5718200 A | 1/1982 |
| WO | 2011029872 | 3/2011 |

* cited by examiner

PLANAR LOUDSPEAKER

The invention relates to a planar loudspeaker comprising a planar sound panel and a drive unit for driving the sound panel.

DE 10 2015 103 339 A1 discloses such a planar loudspeaker. With regard to a possible embodiment and/or mode of operation of a planar loudspeaker, especially of the drive unit, DE 10 2015 103 339 A1 is included or referred to also with regard to the practicability and/or complete disclosure.

In the case of funnel- or cone-shaped loudspeakers that generate spherical waves, a so-called acoustic short circuit occurs, in which the waves radiated to the front and rear cancel each other out. The short circuit must be prevented by structural measures in the housing.

In contrast, planar loudspeakers generate mainly planar waves or planar parallel waves. The sound panel is excited in a planar and homogeneous manner and, especially, generates a planar wave front. As a result, the acoustic short circuit is largely eliminated. The loudness decreases much more slowly with increase in distance for planar waves than for spherical waves. There are also fewer reflections.

Furthermore, planar loudspeakers allow much flatter designs, because no large-volume housings are required. As no special tools are needed for manufacturing planar speakers, they are less expensive.

The sound panel of a planar loudspeaker is conventionally attached to a support frame by means of an elastic retaining element that runs like a groove along the edge of the sound panel. This restricts the sound panel's freedom of movement, a fact which impairs the acoustic result.

As a result of the dead weight of the sound panel and/or of other dynamic movement processes, the centering of a drive unit can be impaired. Up to now, this problem has been solved in planar loudspeakers by introducing a magnetic fluid to mount a coil carrier of the drive unit. However, this only works above a certain minimum current, i.e. at higher volumes, but not at lower volumes.

However, this is associated with additional material outlay and thus costs.

It is therefore an object of the invention to improve a planar loudspeaker of the type mentioned at the outset as well as a corresponding manufacturing process such that centering of a drive unit is performed simply and inexpensively, whereby the sound, especially, is at least not substantially changed.

This object is solved by the device as well as the method of the independent claims.

The inventive loudspeaker is configured as a planar loudspeaker. In contrast to funnel-shaped and/or cone-shaped loudspeakers, planar loudspeakers have a flat shape.

In particular, the planar loudspeaker does not have a loudspeaker basket and/or a support frame. Especially, there is no need, for example, for a rigid attachment to the outer rim.

Thus, there is no need for complex manufacturing, e.g. milling, of the shape. For example, a recess of any shape is merely incorporated into the front. Preferably, merely a recess in the shape of the sound panel is incorporated into the front, whereby the recess is especially large enough for the sound panel to move freely therein.

The sound panel, which is set into vibration, is configured to be planar, especially flat and/or panel-shaped.

This makes for a compact and/or flat design. For example, the planar loudspeaker can be attached to a wall in the manner of a picture or a flat-screen.

The sound panel can be formed as a flat diaphragm. For example, the planar speaker can be a flat diaphragm speaker.

Alternatively, the sound panel can also replace a diaphragm. Thus, the sound panel can be configured to be particularly rigid. Preferably, the sound panel consists of a lightweight material or a material composite. In particular, the sound panel can be configured as a "carbon sandwich". For example, a Rohacell® material can be combined with carbon, especially by baking.

The planar loudspeaker comprises a mounting. In particular, the sound panel can be connected, preferably indirectly, to the mounting. For example, the sound panel can be attached to a wall or a stand via the mounting.

A support frame for the sound panel is unnecessary, but is nevertheless conceivable.

The mounting can have a one-piece or multi-piece configuration.

The planar loudspeaker comprises at least one drive unit for driving the sound panel. Preferably, the drive unit is attached to the mounting.

In particular, the drive unit is configured to set the sound panel vibrating to generate sound. Preferably, the drive unit is configured as an electrodynamic drive. In this regard, especially, a conductor through which current flows, e.g. a wire, can be held in a magnetic field. A force is thereby exerted on the sound panel connected to the drive unit.

The planar loudspeaker comprises at least one stabilizing device, not surrounding the drive unit, for stabilizing any movement of the sound panel.

In conventional funnel-shaped or cone-shaped loudspeakers, the stabilizing device surrounds the circular, three-dimensional drive unit. There, the drive unit acts at a point on the diaphragm. The stabilizing device surrounds the drive unit and ensures that the diaphragm is returned to its rest position.

However, the stabilizing device can have the effect of altering the sound. This also applies to conventional planar loudspeakers, in which the stabilizing device is arranged at the edge of the sound panel and thus also surrounds the drive unit.

In accordance with the invention, by contrast, the drive unit is not surrounded by the stabilizing device, although an additional stabilizing device at the edge is possible in principle. Preferably, however, the stabilizing device is spaced at a distance from the edge.

In particular, the drive unit and the stabilizing device are spaced apart from each other. The sound panel can thus be stabilized, with only very slight sound interference.

It was surprising that a stabilizing device arranged in such a way fulfils, as it were, a dual function, centering the drive unit in addition to stabilizing or attaching the sound panel. In particular, the stabilizing device ensures that only the desired piston movements are permitted and that all other movements, such as tilting, horizontal displacement and/or axial twisting, are prevented.

In contrast to a stabilizing device arranged e.g. at the edge, no magnetic fluid or the like is necessary for this.

A coil, e.g. a magnetic field coil and/or voice coil, of the drive unit is centered by the stabilizing device, especially automatically. Axial, vertical and/or horizontal rotation of the coil is prevented as a result. The upper and lower edges of the coil carrier run parallel with the edges of the magnets as a result, especially during the entire movement sequence, and thus in the magnetic field in the desired manner.

The stabilizing device is arranged between the sound panel and the mounting and has at least one stroke section which is configured to be movable, flexible and/or elastic.

For example, the modulus of elasticity can be less than 20 GPa, 15 GPa, 10 GPa, 5 GPa, 1 GPa or 0.1 GPa.

The stroke section can execute a stroke movement of between 1 mm and 10 mm, preferably of between 4 mm and 6 mm.

The smaller the area of the sound panel, the greater the stroke movement, in particular, has to be.

The stabilizing device can be attached to the sound panel and/or the mounting, especially via an adhesive. The sound panel is dynamically fixed to the mounting by the stroke section. The sound panel can thus, and especially only, execute the desired piston movement.

The planar loudspeaker comprises at least one centering device, not surrounding the drive unit, for centering the sound panel and/or at least a part of the drive unit, especially of a panel-shaped coil carrier. Preferably, a voice coil can be centered between bar magnets.

The centering device is arranged in a different plane than the stabilizing device.

By virtue of the fact that the stabilizing device is arranged in a first plane and the centering device in a second plane, in particular only desired piston movements are permitted, with all other movements, e.g. tilting, horizontal displacement and/or axial twisting, being prevented.

The centering device also has a stroke section which is configured to be movable, flexible and/or elastic.

For example, the modulus of elasticity can be less than 20 GPa, 15 GPa, 10 GPa, 5 GPa, 1 GPa or 0.1 GPa.

The stroke section can execute a stroke movement of between 1 mm and 10 mm, preferably of between 4 mm and 6 mm.

The smaller the area of the sound panel, the greater the stroke movement, in particular, must be.

The centering device can be attached to the sound panel and/or the mounting, especially via an adhesive. As a result of the stroke section, the sound panel is dynamically fixed to the mounting. The sound panel can thus, especially only, execute the desired piston movement.

The centering device can especially be configured so as to be identical with the stabilizing device. Preferably, however, they have different configurations. For example, the stabilizing device—in contrast to the centering device—can be designed as a pot spider.

Preferably, the stabilizing device has a larger diameter than the centering device.

The centering device and the stabilizing device can, especially, be arranged coaxially and/or concentrically with respect to one another. The overall result is, as it were, a spider that acts linearly in the stroke direction. The centering device and the stabilizing device can especially move in opposite directions to one another.

Alternatively, the centering device and the stabilizing device can also be arranged at different locations and consequently not one above the other. For example, a triangular arrangement of the centering device(s) and the stabilizing device(s) is conceivable.

The stabilizing device can especially be movably connected to the sound panel, while the centering device can be movably attached to the mounting. As a result, the stabilizing device and the centering device are each fixed on one side.

The stabilizing device can preferably have a stabilizing support. This can be connected centrally to the stroke section, for example. In particular, the stabilizing support can be of a rigid configuration, e.g. a tube.

The stabilizing support can be fixedly attached to the mounting, e.g. adhesively bonded. Thus, only the section of the stabilizing device facing the sound panel is movable.

In contrast, the centering device can preferably have a centering support. This can be connected centrally to the stroke section, for example. In particular, the centering support can be rigidly designed, e.g. as a tube.

The centering support can be fixedly attached to the sound panel, e.g. adhesively bonded. Therefore, only the section of the centering device facing the mounting is movable.

Preferably, the diameter of the centering support is smaller than the diameter of the stabilizing support. In particular, the centering support can be arranged inside the stabilizing support.

As a result of this arrangement, the planar loudspeaker is stabilized in different planes. In particular, the sound panel and/or the drive unit is guided, stabilized and/or centered as a result. Nevertheless, a piston-like stroke movement is facilitated.

Further embodiments of the invention can also be found in the dependent claims, the description and the accompanying drawings.

According to one embodiment, the drive unit has a panel-shaped coil carrier with a coil configured thereon and with a magnet device, wherein the coil carrier is arranged in a gap between two magnet units of the magnet device.

The voice coil moves especially between two bar magnets, e.g. neodymium magnets. The coil carrier is movable in a direction perpendicular to a connecting line between the two magnet units, especially as a function of the electromagnetic interaction between the coil and the magnet device.

In particular, the coil is wound such that it extends at least substantially along a plane oriented parallel with a direction of movement.

A plurality of coil layers, e.g. two, three, four, five, six or more, can be provided. In particular, the coil layers can be arranged so as to be parallel with each other.

According to a further embodiment, at least or exactly two, three, four, five, six or more, drive units are provided. In particular, the sound panel is driven in parallel by two linear drives. The drives act in a planar manner, i.e. not in a punctiform manner. As a result, the generation of bending waves, especially, can be prevented.

Preferably, the drive units can be attached to the same mounting, although different mountings are also possible.

In particular, the stabilizing device is arranged between the drive units.

According to a further embodiment, the stabilizing device is arranged centrally at the sound panel. For example, exactly one stabilizing device can be provided.

According to a further embodiment, several stabilizing devices are distributed across the sound panel and are arranged especially at four corner areas of the sound panel. The sound panel is uniformly supported, as a result of which stability is increased.

Optionally, a central stabilizing device can additionally be provided.

According to a further embodiment, the stroke section of the stabilizing device and/or the centering device comprises or consists of a rubber, foam and/or fabric material. By means of this elastic and/or flexible material, a stroke movement can be guided and/or limited. Alternatively, the stroke movement can also be guided and/or limited, e.g., by means of a spring device.

According to a further embodiment, the stroke section of the stabilizing device and/or the centering device has a recess, especially a central recess. Alternatively, however, the stroke section can also be closed and have, e.g., a base or cover.

The stroke section can especially be attached, e.g. adhesively bonded, to the edge of the recess on the sound panel or the mounting.

According to a further embodiment, the stroke section has an annular configuration. In particular, a recess of the stroke section can also be annular.

The term annular is to be understood in a broad sense. Thus, in addition to annular shapes, it includes oval shapes. Alternatively, an angular design of the stroke section is also conceivable.

According to a further embodiment, the stroke section comprises or consists of a beading and/or spider.

A spider, which is also called a centering spider, can e.g. be configured as a radial and/or concentric spring element, e.g. a bidirectional disk spring.

In particular, two oppositely oriented, interconnected spiders can also be provided, which form the stroke section.

According to a further embodiment, the stabilizing device comprises at least one retaining ring. In particular, a preferably annular stroke section can be attached to the retaining ring. Preferably, the stroke section is arranged coaxially and/or concentrically on the retaining ring.

The retaining ring can also be solid, e.g. in the form of a puck or a disk.

The stroke section, especially a beading, can be arranged, e.g., between the retaining ring and the sound panel or between the retaining ring and the mounting.

According to a further embodiment, the stabilizing device comprises two retaining rings, which preferably have different diameters, wherein the stroke section, especially a beading, is arranged between the retaining rings.

For example, the smaller-diameter retaining ring can be connected to the sound panel and the larger-diameter retaining ring can be connected to the mounting. In this regard, less weight especially is applied to the sound panel. However, the converse orientation is also conceivable. Thus, the smaller-diameter retaining ring can be connected to the mounting and the larger-diameter retaining ring can be connected to the sound panel.

As a result of the different diameters, the retaining rings can especially be telescoped into one another.

The stroke section connects the retaining rings to one another. In particular, the stroke section can be adhesively bonded to the retaining rings.

According to one embodiment, at least one retaining element, not completely surrounding the sound panel, is provided at the sound panel.

In particular, the retaining element is configured to attach the sound panel to a support frame. As a result, centering and/or stabilization especially can be achieved.

Preferably, the sound panel in its entirety is not connected or connectable to a support frame via the retaining element. Thus, for example, air between the sound panel and the support frame can escape, as a result of which, e.g., an acoustic curtain is prevented. A sealed, enclosed housing is unnecessary for planar loudspeakers—in contrast to the case for funnel-shaped or cone-shaped loudspeakers—as there is only a slight risk of acoustic short circuits.

The retaining element is preferably elastic. As a result, a relative movement between the sound panel and the support frame is especially facilitated.

The retaining element can, for example, comprise or consist of a plastic, rubber, foam, fabric, textile and/or paper material.

In particular, the retaining element can be U-shaped. During a piston-like movement of the sound panel, it can unroll, as it were. One arm of the retaining element can be connected, e.g. adhesively bonded, to the sound panel, while the other arm can be connected, e.g. adhesively bonded, to the support frame.

The sound panel can preferably have a plurality of, e.g., two, three, four, five, six, seven, eight or more, retaining elements. In particular, the retaining elements can be arranged at different, e.g. opposite, sides of the sound panel. Preferably, two retaining elements are located opposite each other in each case. Any lateral spring force that arises is canceled out in this way.

The invention also relates to a method of manufacturing a planar loudspeaker. A stabilizing device, which has at least one stroke section that is configured to be movable, flexible and/or elastic, is arranged between the sound panel and a mounting for stabilizing a planar sound panel.

The stabilizing device does not surround a drive unit for driving the sound panel. Thus, the stabilizing device is spaced apart from the drive unit.

In particular, the stabilizing device can be attached to the mounting and/or the sound panel by means of a hook-in, hook-and-loop, clamp, plug-in, latch, magnetic, pin and/or screw device. Alternatively or additionally, non-detachable connections are also conceivable, e.g. adhesive, riveted, soldered and/or welded connections.

A section of the stabilizing device facing the mounting is preferably adhesively bonded to the mounting.

In particular, a section of the stabilizing device facing the sound panel is adhesively bonded to the sound panel.

For example, a stroke section can be bonded to a lower side of the mounting or a retaining ring and to an upper side of the sound panel or a retaining ring.

The sound panel is thus attached indirectly to the mounting via the stabilizing device. Due to the fact that the stabilizing device has a stroke section, the sound panel is fixed dynamically and not rigidly.

A centering device which has at least one movable, flexible and/or elastic stroke section is arranged in a different plane than the stabilizing device for the purpose of centering the sound panel and/or at least part of the drive unit.

The centering device does not surround the drive unit for driving the sound panel. Thus, the centering device is spaced apart from the drive unit.

In particular, the centering device can be attached to the mounting and/or the sound panel by means of a hook-in, hook-and-loop, clamp, plug-in, latch, magnetic, pin and/or screw device. Alternatively or additionally, non-detachable connections are also conceivable, e.g. adhesive, riveted, soldered and/or welded connections.

A section of the centering device facing the sound panel, especially a centering support, is preferably adhesively bonded to the sound panel.

In particular, a section of the centering device facing the mounting is adhesively bonded to the mounting.

For example, a lower side of a stroke section can be adhesively bonded to the mounting.

Thus, the sound panel is attached indirectly to the mounting via the centering device. Due to the fact that the centering device has a stroke section, the sound panel is fixed dynamically and not rigidly.

All embodiments and components of the device described herein are particularly configured for manufacture by the method described herein. Furthermore, all embodiments of the device described herein as well as all embodiments of the method described herein can each be combined with one another, especially also detached from the specific embodiment of the context in which they are mentioned.

Figure 2:
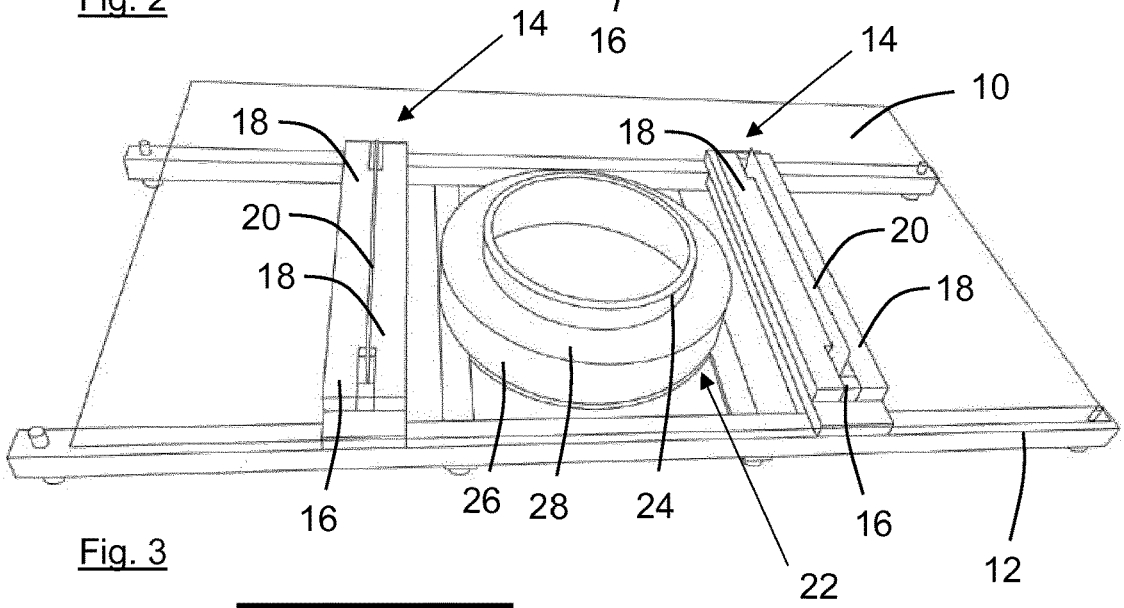
Figure 3:
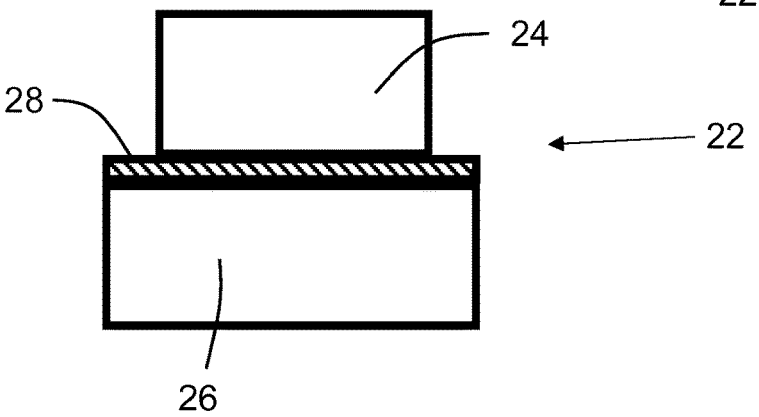
Figure 4:
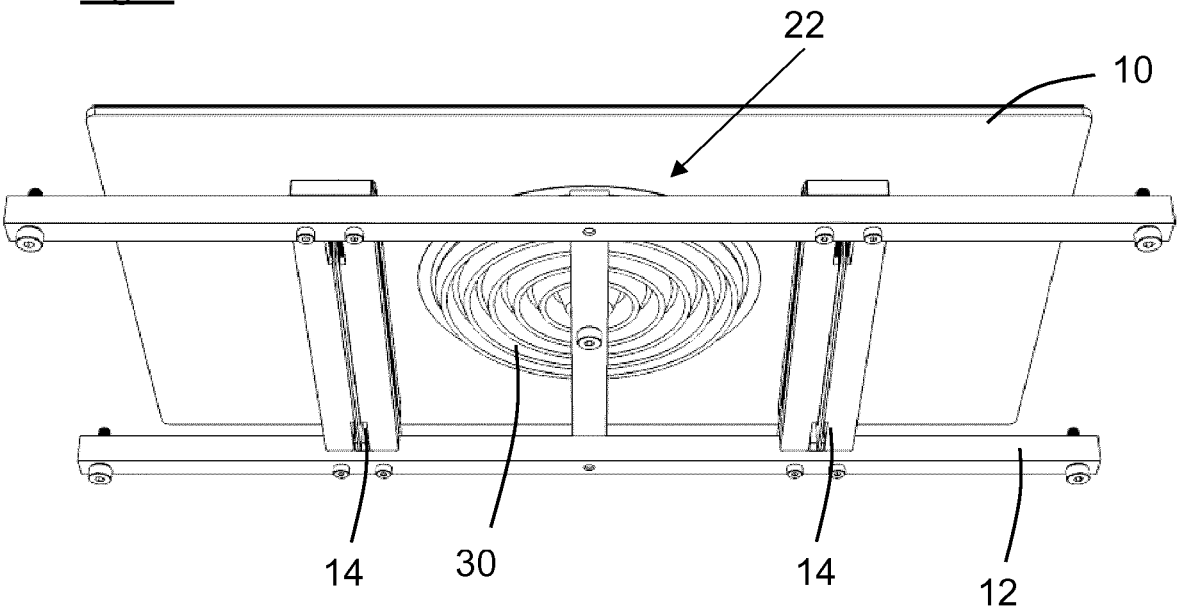
Figure 5:
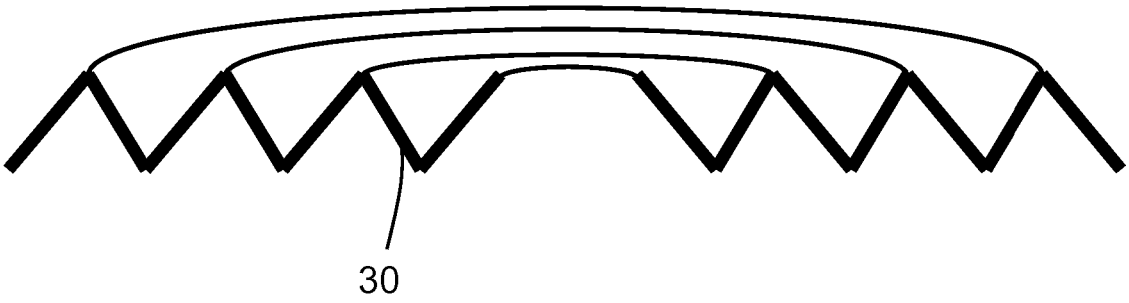
Figure 6:
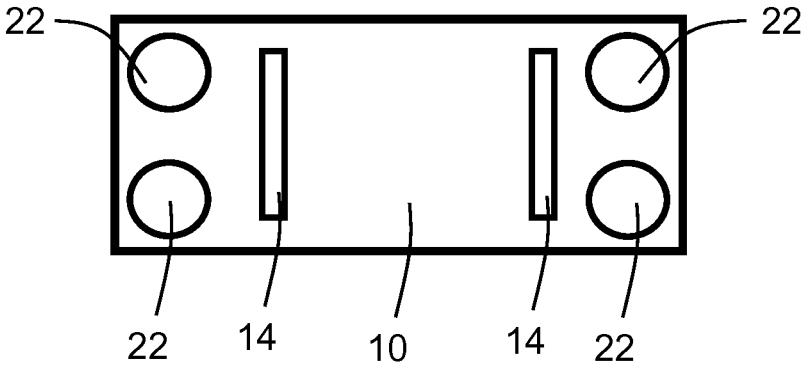
Figure 7:
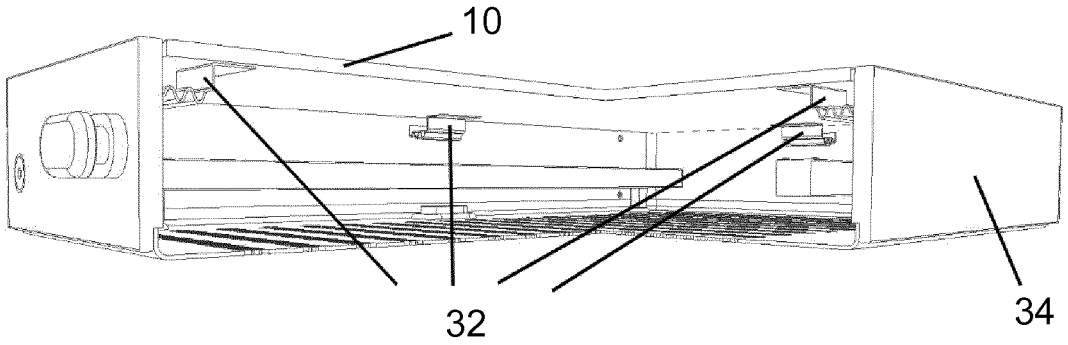
Figure 8:
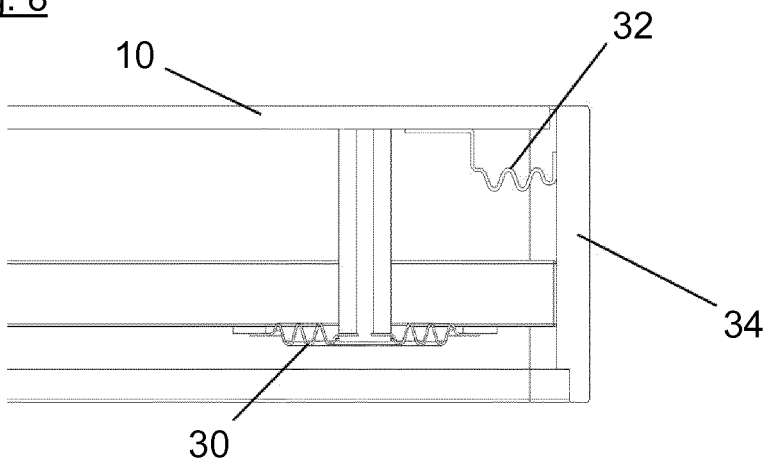
Figure 9:
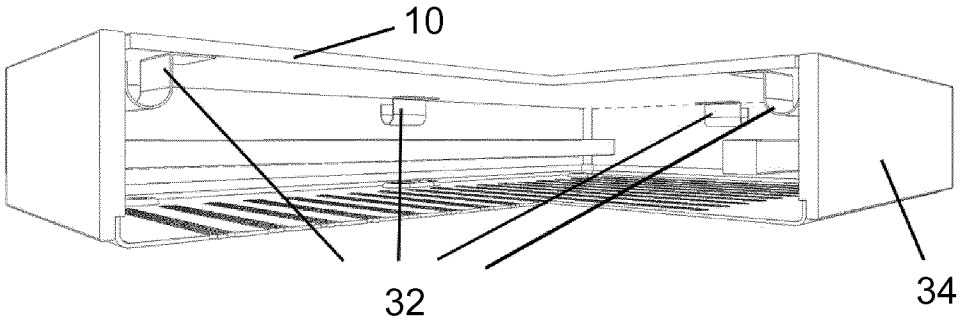
Figure 10:
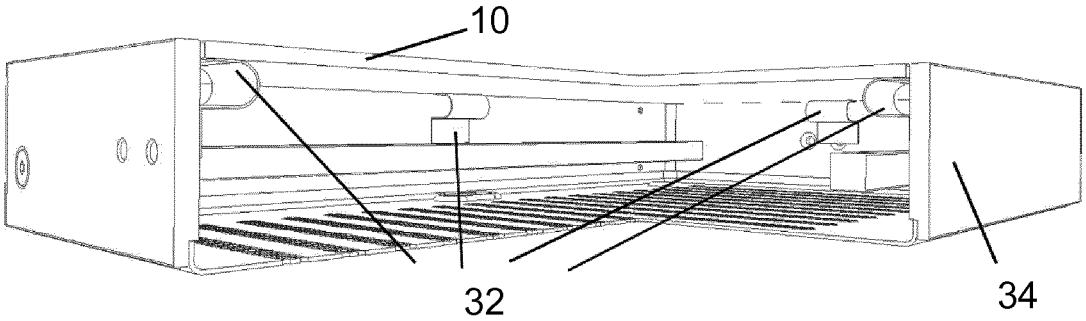
Figure 11:
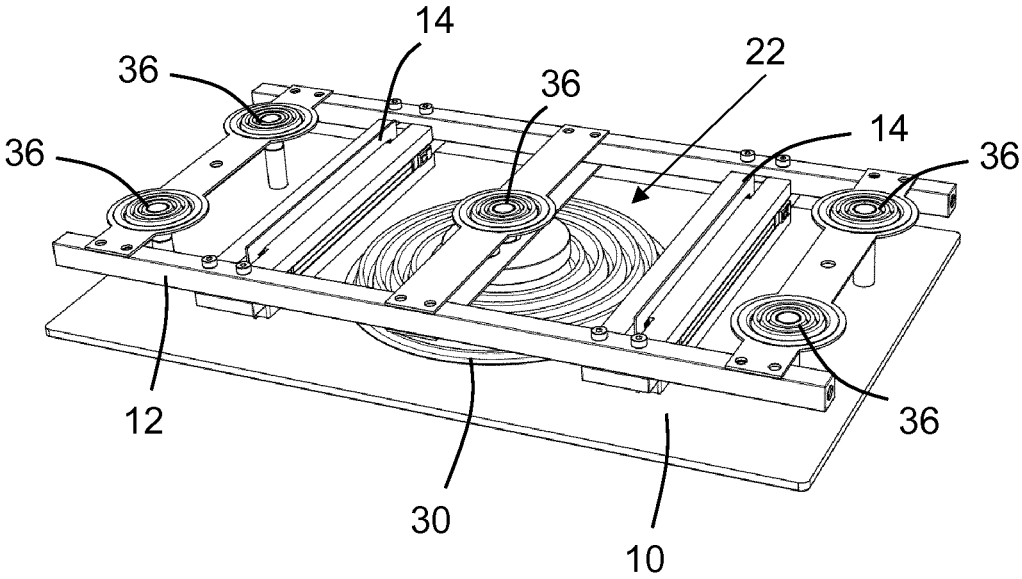
Figure 12:
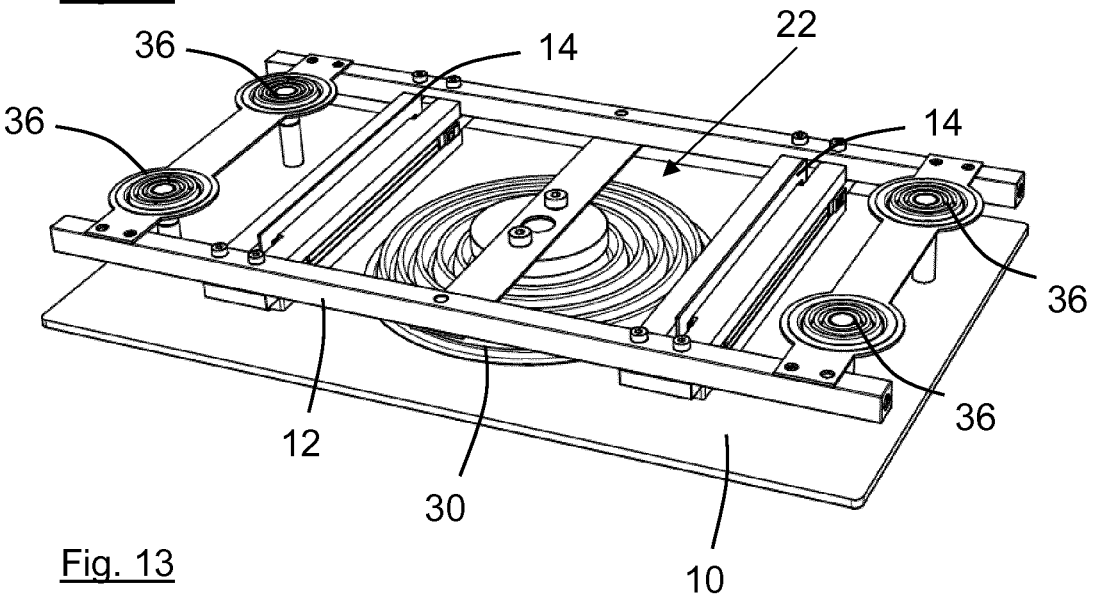
Figure 13:
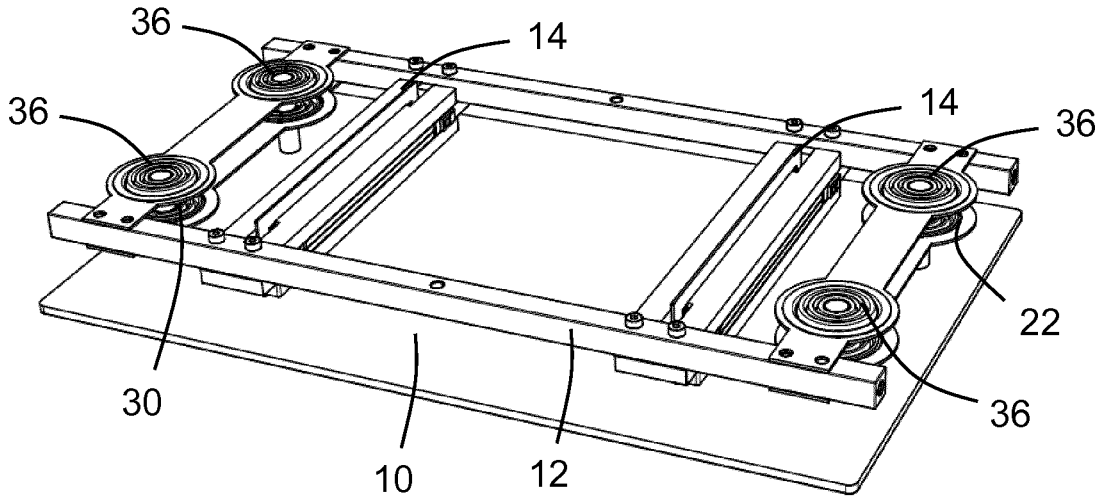
Figure 14:
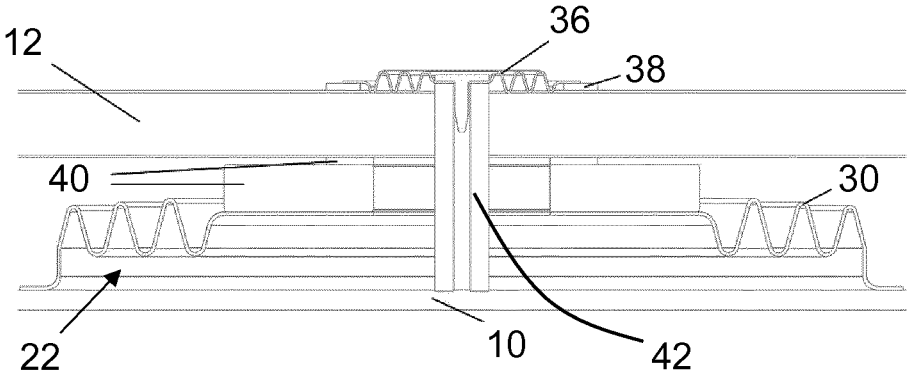

The invention is described below by way of example with reference to the drawings. They show in:

FIG. 1 a perspective bottom view of an embodiment of a planar loudspeaker,

FIG. 2 a perspective plan view of an embodiment of a planar loudspeaker,

FIG. 3 a side view of an embodiment of a stabilizing device of a planar loudspeaker, FIG. 4 a perspective bottom view of a further embodiment of a planar loudspeaker, FIG. 5 a cutaway perspective view of an embodiment of a stabilizing device of a planar loudspeaker, FIG. 6 a plan view of a further embodiment of a planar loudspeaker, FIG. 7 a cutaway perspective view of a further embodiment of a planar loudspeaker, FIG. 8 a cross-sectional view of an embodiment of a planar loudspeaker, FIG. 9 a cutaway perspective view of a further embodiment of a planar loudspeaker, FIG. 10 a cutaway perspective view of a further embodiment of a planar loudspeaker, FIG. 11 a perspective plan view of an embodiment of an inventive planar loudspeaker, FIG. 12 a perspective plan view of a further embodiment of an inventive planar loudspeaker, FIG. 13 a perspective plan view of a further embodiment of an inventive planar loudspeaker, and FIG. 14 a cross-sectional view of a further embodiment of an inventive planar loudspeaker.

First of all, it should be noted that the embodiments shown are of a purely exemplary nature. Thus, individual features can be implemented not only in the combination shown, but also on their own or in other technically useful combinations. For example, the features of one embodiment may be combined arbitrarily with features of another embodiment. In particular, the shape, number and/or position of the stabilizing device(s), centering device(s) and drive units can vary.

Where a drawing contains a reference numeral which is not explained in the directly associated descriptive text, reference is made to the corresponding previous or subsequent deliberations in the description of the drawings. Thus, the same reference numerals are used for the same or comparable components in the drawings and are not explained again.

FIG. 1 shows a planar loudspeaker comprising a planar sound panel 10 and a mounting 12. The mounting 12 can comprise several individual parts connected to one another, especially screwed together. Alternatively, the mounting 12 can also be configured as a single piece.

Two drive units 14 are attached, especially screwed, to the mounting 12.

The drive units 14 each comprise a magnet device 16 having two magnet units 18 and a panel-shaped coil carrier 20 arranged in a gap between them.

A stabilizing device 22 is arranged between the drive units 14. The stabilizing device 22 extends between the sound panel 10 and the mounting 12.

As shown in the plan view according to FIG. 2 (the sound panel 10 is shown transparent), the stabilizing device 22 comprises a first retaining ring 24 and a second retaining ring 26. The first retaining ring 24 has a smaller diameter than the second retaining ring 26.

As can be seen in FIG. 3, too, a stroke section configured as a beading 28 is provided between the retaining rings 24, 26. As a result of the stroke section 28, the retaining rings 24, 26 are connected to one other such that they can move relative to one other. The stabilizing device 22 can thus reproduce the movement of the sound panel 10, which is driven, especially synchronously, by the drive units 14.

In FIG. 4, the stabilizing device 22 is formed by a spider 30. Retaining rings are unnecessary.

According to the cross-sectional view in FIG. 5, the spider 30 is configured as a type of concentric spring. The spider 30 can especially have a central recess or it can be closed.

It is also possible for two spiders 30 to be used together. In that event, the spiders 30 can be attached coaxially one above the other in opposite orientations. The spring travel is thereby extended.

In the embodiment shown in FIG. 6, four stabilizing devices 22 are provided instead of one central stabilizing device. These are arranged at the corner areas of the sound panel 10.

FIG. 7 shows a sound panel 10 that is connected to a support frame 34 via retaining elements 32.

The retaining elements 32 are comparatively narrow and do not extend around the entire circumference of the sound panel 10. In particular, the retaining elements 32 are narrower than the distance between two retaining elements 32.

In particular, the retaining elements 32 can be evenly distributed on the sound panel 10. Preferably, at least one retaining element 32 is provided at each side of the sound panel 10. In this way, the sound panel 10 can be stabilized and/or centered at each side.

The retaining elements 32 are preferably elastic. This facilitates in particular relative movement between the sound panel 10 and the support frame 34.

As can be seen in FIG. 8, the retaining element 32 can have an undulating section. As a result, a certain amount of play is facilitated.

One arm of the retaining element 32 can be connected to the sound panel 10, while the other arm can be connected to the support frame 34.

FIG. 9 shows that the retaining element 32 can also have a U-shaped configuration. The arms of the U-shaped retaining element 32 can in particular be oriented parallel with the support frame 34.

The retaining element 32 can, as it were, unroll during a stroke movement of the sound panel 10. In particular, the apex can rise or fall.

As shown in FIG. 10, the arms of the U-shaped retaining element 32 can especially be oriented parallel with the sound panel 10.

The retaining element 32 can, as it were, unroll during a stroke movement of the sound panel 10.

FIG. 11 shows a planar loudspeaker comprising a central stabilizing device 22 and a plurality of centering devices 36. The centering devices 36 are arranged above the stabilizing device 22 and hence in a different plane.

One centering device 36 is arranged coaxially with the stabilizing device 22.

This can be omitted, as may be seen in FIG. 12. The arrangement in different planes ensures sufficient stabilization or centering even if the centering devices 36 and the stabilizing device 22 are not arranged directly one above the other.

As shown in FIG. 13, it is also possible for several, especially decentralized, stabilizing devices 22 to be provided. For example, a stabilizing device 22 can be arranged in each corner area. Immediately above it, for example, can be located a centering device 36 in each case.

In FIG. 14, a centering device 36 is arranged coaxially above a stabilizing device 22. The centering device 36 and the stabilizing device 22 can move relative to one other, especially in opposite directions.

The stabilizing device 22 is movably connected to the sound panel 10, while the centering device 36 can be movably attached to the mounting 12 via a retaining means 38.

Preferably, the stabilizing device 22 can comprise a stabilizing support configured as a stabilizing tube 40. The stabilizing support 40 is fixedly attached, e.g. adhesively bonded, to the mounting 12.

The centering device 36 comprises a centering support configured as a centering tube 42. The centering tube 42 can be hollow or solid.

The centering support 42 is fixedly attached, e.g. adhesively bonded, to the sound panel 10.

Preferably, the diameter of the centering support 42 is smaller than the diameter of the stabilizing support 40. In particular, the centering support 42 is arranged within the stabilizing support 40.

LIST OF REFERENCE NUMERALS

10 Sound panel
12 Mounting
14 Drive unit
16 Magnet device
18 Magnet unit
20 Coil carrier
22 Stabilizing device
24 First retaining ring
26 Second retaining ring
28 Beading, stroke section
30 Spider
32 Retaining element
34 Support frame
36 Centering device
38 Holding means
40 Stabilizing tube, stabilizing support
42 Centering tube, centering support

The invention claimed is:

1. Planar loudspeaker comprising
a planar sound panel (10),
a mounting (12),
at least one drive unit (14) for driving the sound panel (10), and
at least one stabilizing device (22) for stabilizing a movement of the sound panel (10), wherein the stabilizing device (22) is arranged between the sound panel (10) and the mounting (12) and comprises at least a stroke section (28), which is configured so as to be movable, flexible and/or elastic, and
at least one centering device (36) for centering the sound panel (10) and/or at least a part of the drive unit (14), wherein the centering device (36) is arranged in a different plane than the stabilizing device (22) and comprises at least a stroke section (28), which is configured so as to be movable, flexible and/or elastic,
characterized in that
the stabilizing device (22) does not surround the drive unit (14) and the drive unit (14) and the stabilizing device (22) are spaced apart from one another, and
the centering device (36) does not surround the drive unit (14) and the centering device (36) is spaced apart from the drive unit (14).

2. Planar loudspeaker in accordance with claim 1,
characterized in that
the drive unit (14) comprises a panel-shaped coil carrier (20) with a coil configured thereat and a magnet device (16), wherein the coil carrier (20) is arranged in a gap between two magnet units (18) of the magnet device.

3. Planar loudspeaker in accordance with claim 1,
characterized in that
at least two drive units (14) are provided.

4. Planar loudspeaker in accordance with claim 1,
characterized in that
the stabilizing device (22) is arranged centrally at the sound panel (10).

5. Planar loudspeaker in accordance with claim 1,
characterized in that
several stabilizing devices (22) are distributed across the sound panel (10).

6. Planar loudspeaker in accordance with claim 5,
characterized in that
the stabilizing devices (22) are arranged at four corner areas of the sound panel (10).

7. Planar loudspeaker in accordance with claim 1,
characterized in that
the stroke section (28) comprises or consists of a rubber, foam and/or fabric material.

8. Planar loudspeaker in accordance with claim 1,
characterized in that
the stroke section (28) comprises a recess.

9. Planar loudspeaker in accordance with claim 1,
characterized in that
the stroke section (28) has an annular configuration.

10. Planar loudspeaker in accordance with claim 1,
characterized in that
the stroke section comprises or consists of a beading (28) and/or a spider (30).

11. Planar loudspeaker in accordance with claim 1,
characterized in that
the stabilizing device (22) comprises a retaining ring (24, 26).

12. Planar loudspeaker in accordance with claim 1,
characterized in that
the stabilizing device (22) comprises two retaining rings (24, 26), wherein the stroke section (28) is arranged between the retaining rings (24, 26).

13. Planar loudspeaker in accordance with claim 12,
characterized in that
the two retaining rings (24, 26) have different diameters.

14. Planar loudspeaker in accordance with claim 1,
characterized in that
said drive unit is attached to the mounting (12).

15. Planar loudspeaker in accordance with claim 1,
characterized in that
the stroke section (28) comprises a central recess.

16. Method for producing a planar loudspeaker, in which
a stabilizing device (22), which comprises at least a movably, flexibly and/or elastically configured stroke section (28),
is arranged, for the purpose of stabilizing a flat sound panel (10), between the sound panel (10) and a mounting (12), and in which
a centering device (36), which comprises at least a movably, flexibly and/or elastically configured stroke section (28), is arranged, for the purpose of centering the sound panel (10) and/or at least a part of the drive unit (14), in a different plane than the stabilizing device (22), characterized in that the stabilizing device (22) does not surround a drive unit (14) for the purpose of driving the sound panel (10) and the drive unit (14) and the stabilizing device (22) are spaced apart from one another, and the centering device (36) does not surround the drive unit (14) and the centering device (36) is spaced apart from the drive unit (14).

* * * * *